United States Patent [19]

Doutney

[11] Patent Number: 4,640,599

[45] Date of Patent: Feb. 3, 1987

[54] METHOD AND APPARATUS FOR NEUTRALIZING RESIDUAL CHARGE ON A PHOTOCONDUCTIVE SURFACE

[75] Inventor: George J. Doutney, Danbury, Conn.

[73] Assignee: Pitney Bowes Inc., Stamford, Conn.

[21] Appl. No.: 787,347

[22] Filed: Oct. 15, 1985

[51] Int. Cl.[4] ..... G03G 15/00

[52] U.S. Cl. ..... 355/3 CH; 355/14 CH; 355/15

[58] Field of Search ..... 355/3 CH, 15, 14 CH, 355/3 R

[56] References Cited

U.S. PATENT DOCUMENTS

| | | | |
|---|---|---|---|
| 2,890,968 | 6/1959 | Giaimo, Jr. | 355/4 X |
| 3,668,008 | 6/1972 | Severynse | 134/1 |
| 3,780,391 | 12/1973 | Leenhouts | 15/1.5 |
| 4,081,212 | 3/1978 | Wetzer | 355/3 |
| 4,123,154 | 10/1978 | Fisher | 355/15 |
| 4,456,370 | 6/1984 | Hayes, Jr. | 355/3 CHX |
| 4,469,435 | 9/1984 | Nosaki et al. | 355/15 |
| 4,547,060 | 10/1985 | Lindblad | 355/3 CHX |

*Primary Examiner*—A. C. Prescott

*Attorney, Agent, or Firm*—Peter Vrahotes; Melvin J. Scolnick; David E. Pitchenik

[57] ABSTRACT

It has been found that applying an alternating charge to the cleaning brush of a xerographic printer of the reversal development type results in superior neutralization of the residual charge on the photoconductor. This has the advantage of achieving subsequent charging that is uniform.

7 Claims, 3 Drawing Figures

METHOD AND APPARATUS FOR NEUTRALIZING RESIDUAL CHARGE ON A PHOTOCONDUCTIVE SURFACE

BACKGROUND OF THE INVENTION

In the field of xerography, a copy of an original is produced by reflecting light from the original onto an electrostatically charged photoconductive surface. As a result of this exposure, that portion of the surface exposed to light reflected from the original will be discharged and a charged image will remain on the photoconductive surface that represents the text or pattern contained on the original from which light was not reflected. The charged image is then developed by placing toner of opposite charge onto the photoconductive surface. The developed image is transferred to a plain sheet of paper and the toner transferred onto the sheet is fused by heat or pressure. Generally, the toner comes from a development powder or developer which is made of two components, carrier particles and toner particles. The carrier particles are normally iron particles that are substantially larger than the toner particles. The toner particles are held to the carrier particles by an electrostatic charge. The electrostatic charge that keeps the toner particle attracted to the carrier particle is a triboelectric charge and is created when the particles are rubbed against one another.

As a development powder is brought into contact with the imaged photoconductive surface, the toner is attracted away from the charged carrier particles by the higher charge of the image relative to the carrier particles. After the toned image is conveyed past the development station, it is attracted to the sheet of paper by a charge produced by a device such as a corona, which charge is opposite to that of the toner. As the photoconductor continues past the transfer station, it is cleaned by a device such as a cleaning brush. As the photoconductor approaches the cleaning brush it still has thereon toner that was not transferred onto the sheet of paper and residual charges. Various devices have been supplied for removing the toner from the surface of the photoconductor and rendering such photoconductor neutral in charge. Although great emphasis in the art has been applied to removing the residual toner, little emphasis has been placed on removing the residual charge that remains on the photoconductor. One method of removing residual toner is by use of a device that produces ionized air as is disclosed in U.S. Pat. No. 3,668,008. Another method is the use of a fibrous brush that contacts the surface of the photoconductor to physically remove residual toner. An example of such a device is shown and described in U.S. Pat. No. 4,123,154. Although these structures worked well for removing toner particles, it was found that they were not efficient in removing the residual charge remaining after the photoconductor subsequent to the transfer operation, particularly in a reversal development process. A reversal development process is one in which the image area of a photoconductor is discharged rather than the background and toner is attracted to the image area by differences in potential.

BRIEF DESCRIPTION OF THE INVENTION

It has been discovered that supplying an alternating charge to the fibrous conductive brush of a cleaning station is effective for removing residual charge from a photoconductor in a reversal development process. By removal of such residual charge, cleaning efficiency is improved. More importantly, the photoconductor is uniformly discharged which enables uniform charging on subsequent process cycles.

DETAILED DESCRIPTION OF THE PREFERRED EMBODIMENT

Figure 1:
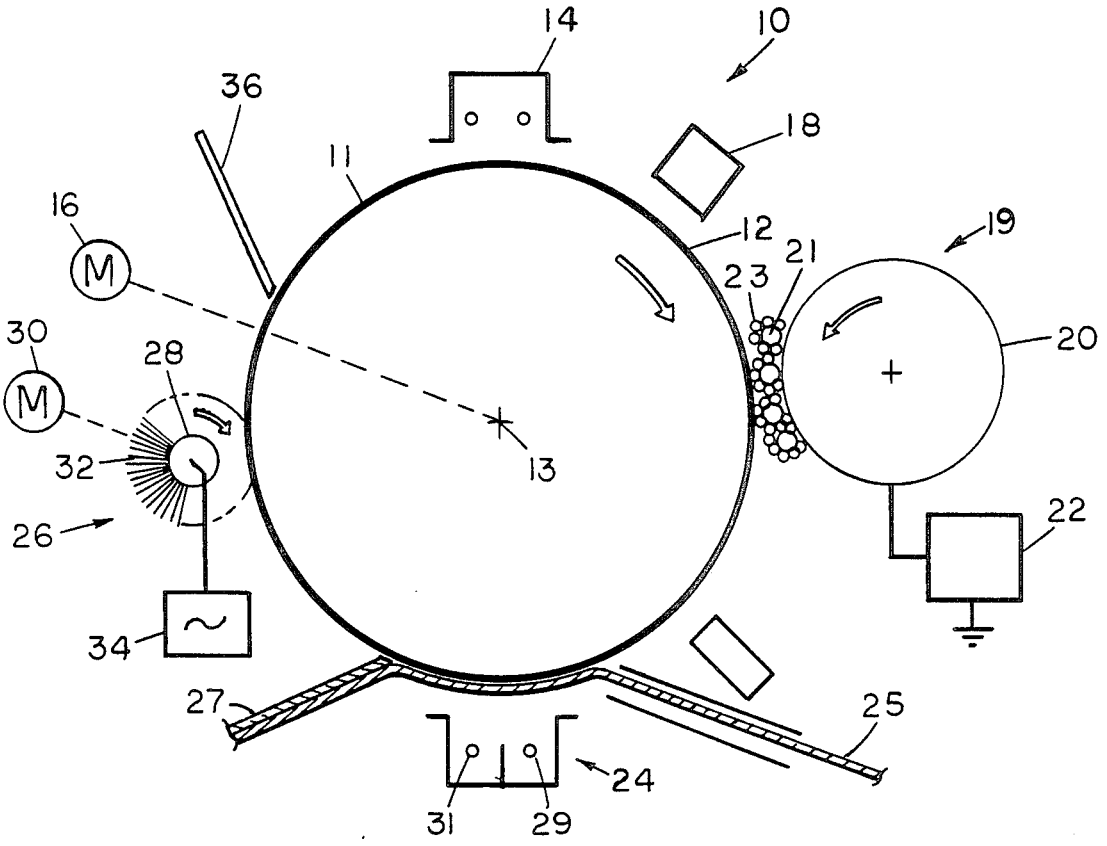
FIG. 1 is a cross-sectional view, partially schematic, of a xerographic printer of the reversal development type that incorporates the instant invention.

Referring now to FIG. 1, a xerographic printer of the reversal development type is shown generally at 10. This printer includes a drum 11 having a photoconductive surface 12 thereon, the drum being rotatably mounted on a shaft 13. A motor 16 is provided to rotate the drum 11 in the direction indicated by the accuate arrow. The surface 12 is preferably composed of selenium or an organic photoconductive material. Disposed about the photoconductive surface 12 are a plurality of stations. A charging station 14 addresses the photoconductive surface 12 to impart a charge thereon. This charging station 14 may be a corona that places a positive charge on the photoconductive surface 12. Following the charging station 14, is an imaging station 18 which may be a light emitting diode unit shown and described in U.S. Pat. No. 4,455,562. Downstream from the imaging station 18 is a development station generally shown at 19 that includes a magnetic brush unit 20 that is biased by a voltage supply 22. Shown on the surface of the magnetic brush unit is the development powder which is made up of carrier particles 21 and toner particles 23 that adhere to the surfaces of the carrier particles.

Downstream from the development station 19 is the transfer station 24 which may be a corona that has two sections, one of which has at least one wire 29 which provides a negative DC charge and the other section has at least one wire 31 that provides a positive AC charge. A web or sheet of paper 25 is conveyed between the drum 11 and transfer station 24 so that the toner placed upon the photoconductive surface 12 by the development station 19 may be attracted to the sheet by the charge imposed by the negative DC charge 29 of the transfer station. The positive AC charge 31 acts as a detact, i.e., attract the sheet 25 away from the drum 11. A sheet separator 27, in cooperation with the AC charge 31, facilitates removal of the sheet 25 from the surface 12 of the drum 11.

A cleaning brush 26 is provided that includes a shaft 28 attached to a motor 30 to be driven in the direction indicated by the arcuate arrow. Conductive fiber bristles 32 extend from the shaft 28 and engage the photoconductive surface 12. A source of AC voltage 34 is connected to the shaft 28 of the brush 26 to impart an AC charge to the bristles 32. Intermediate the cleaning brush 26 and the charge station 14 is a cleaning blade 36 that is used to physically remove residual tone particles from the surface 12.

The operation of the device shown in FIG. 1 will now be described. It will be appreciated that what will be described is a point on the photoconductive surface 12 as it is rotated, as indicated by the arcuate arrow, past the various stations. Although it is a point that is being described it will be portrayed as the photoconductive surface being conveyed. When the photoconductive surface 12 is in its home position, it will be given a charge, normally positive, by the charge station 14. The drum will be rotated by the motor 16 as indicated by the arcuate arrow. The photoconductive surface 12 is conveyed past the imaging station 18. Assuming that the imaging station 18 is a light emitting diode array, portions of the photoconductor representing the text or pattern to be reproduced will be discharged. Upon imaging taking place, the photoconductor 12 is then conveyed past the development station 19. The development station 19 is biased with a charge the same as, i.e. positive, that of the photoconductive surface 12 but less than the charge of the unimaged area. Toner particles 23 to be transferred will have the same polarity as the photoconductive surface 12 but with a higher potential than the imaged area and a lower potential than the unimaged area.

The positively charged toner particles 23 become attracted to the discharged areas of the photoconductive surface 12 in a reversal development process because these discharged areas, although slightly positive, are much more negative, relatively speaking, than the development unit 19 or the undischarged areas of the photoconductive surface. The developed image then passes the transfer station 24 where the positive toner particles 23 that form the image are transferred to a paper sheet 25 by the application of the DC negatively charged corona section 29. This can import a negative charge on the photoconductive surface 12, especially between successive sheets 27, which if not totally discharged can result in non-uniform charging of the photoconductive drum on subsequent process cycles as is demonstrated by FIGS. 2 and 3.

After the photoconductive surface 12 passes the transfer station 24, the sheet 25 is removed from the surface 12 by the combination of the AC positively charged corona section 31 and the sheet separator unit 27. The cleaning brush shown generally at 26 is located downstream from the sheet separator 27 and serves the purpose of removing residual toner from the surface 12 as well as any residual charge. A source of alternating power 34 is connected to the cleaning brush 26 to supply an AC potential thereon.

Figure 2:
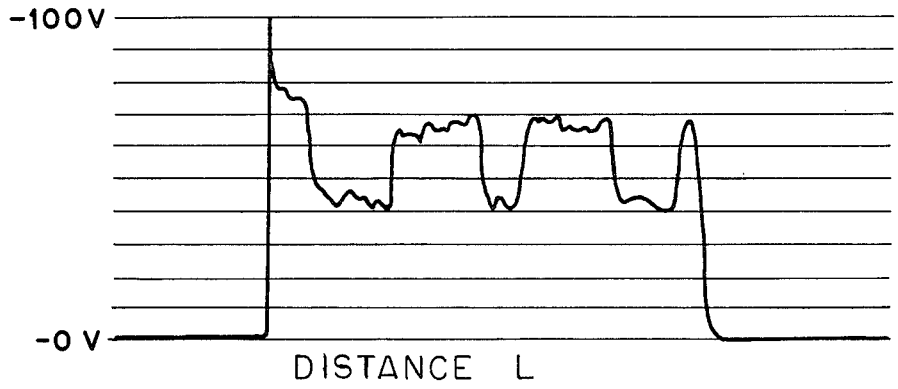
FIG. 2 is a graph representing the charge measured on a photoconductive surface at the development zone in prior devices.
Figure 3:
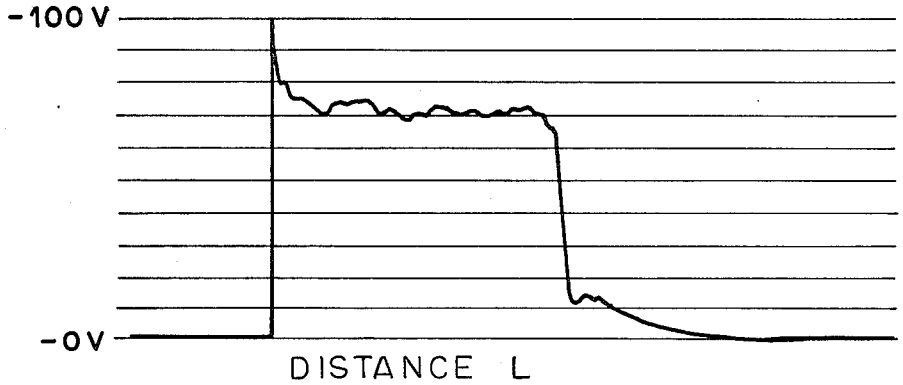
FIG. 3 is a graph similar to FIG. 1 except showing such charge measurement from a photoconductive surface utilized in the instant invention.

It has been found that supplying an AC charge to the cleaning brush 26 serves to neutralize the photoconductive surface 14 residual charges, regardless of polarity, to assure charge uniformity in subsequence cycles. The usefulness of the device becomes evident by comparing the graphs in FIG. 2 and FIG. 3 where the charge in volts on the photoconductive surface 12 is measured along a distance L between the charge station 14 and development station 19, without AC power supplied to the cleaning station 26 and with such AC power being supplied, respectfully. As can be seen, the level of charge in FIG. 2 is non-uniform. The low portions of the curve represent the charge on the photoconductive surface 12 in the areas between sheets 25 conveyed on the drum 11 in prior cycles. In FIG. 3 it is seen that placing an AC charge on the cleaning brush 26 results in a relatively uniform charge on the photoconductive surface as measured at the development zone. This results from the fact that the AC charge neutralizes latent charges on the photoconductive surface 12 after that portion of the photoconductive surface 12 passes the transfer station 24 thereby allowing the charge station 14 to charge the photoconductor more uniformally.

What is claimed is:

1. In a device for discharging residual charge on a photoconductive surface of a reversal development type printer, the combination comprising: a brush in contact with the photoconductive surface, means for rotating said brush, means for conveying said photoconductive surface past said brush, and means for applying an AC potential to said brush.

2. The device of claim 1 wherein said brush includes conductive bristles that engage said photoconductive surface and said AC potential is applied to said bristles.

3. In a method of neutralizing the charge on a photoconductive surface, the steps, comprising:

placing a photoconductive surface into contact with a conductive brush;

conveying the photoconductive surface past the brush; and applying an AC potential to the brush.

4. In a xerographic printer of the reversal development type, the combination comprising:

a photoconductive surface, means for placing a charge on said photoconductive surface, means for selectively discharging said photoconductive surface to create an image, means for applying charged toner particles to said image, means for transferring said image to a sheet, and means including an AC potential for discharging residual charge on the photoconductive surface.

5. The apparatus of claim 4 including means for changing said toner particles with the same, but lower, polarity as the undischarged portion of said photoconductor.

6. The apparatus of claim 5 wherein said means for discharging the residual charge is a brush having conductive bristles.

7. In a method of printing, the steps comprising:

providing a photoconductive surface, placing a charge on the photoconductive surface, selectively discharging portions of the photoconductive surface, contacting the photoconductive surface with toner particles having the same charge as the undischarged portion of the photoconductive surface but of a lower polarity to form an image, contacting the image on the photoconductive surface with a sheet, transferring the toner particles from the photoconductive surface to the sheet, removing the sheet from the photoconductive surface, and applying an AC potential to the photoconductive surface after removal of the sheet from the photoconductive surface.

* * * * *